United States Patent [19]

Lough

[11] 4,291,478

[45] Sep. 29, 1981

[54] INFRARED AIMING LIGHT MOUNTING BRACKET FOR WEAPON

[75] Inventor: Lewis E. Lough, Springfield, Va.

[73] Assignee: The United States of America as represented by the Secretary of the Army, Washington, D.C.

[21] Appl. No.: 97,614

[22] Filed: Nov. 26, 1979

[51] Int. Cl.[3] ..... F41G 1/36

[52] U.S. Cl. ..... 42/1 A

[58] Field of Search ..... 42/1 A, 1 S, 1 ST, 1 F; 33/233, 245, 250, 261; 362/110

[56] References Cited

U.S. PATENT DOCUMENTS

| | | | |
|---|---|---|---|
| 3,739,167 | 6/1973 | Avery | 42/1 A |
| 3,867,764 | 2/1975 | Dunmire et al. | 42/1 A |
| 4,079,534 | 3/1978 | Snyder | 42/1 A |
| 4,152,754 | 5/1979 | deFilippis et al. | 42/1 A |
| 4,161,076 | 7/1979 | Snyder | 42/1 A |

*Primary Examiner*—Charles T. Jordan

*Attorney, Agent, or Firm*—Nathan Edelberg; Milton W. Lee; Max L. Harwell

[57] ABSTRACT

The bracket provides an improved mounting means for conveniently mounting and dismounting an infrared aiming light to a weapon. The bracket has a three point-mounting portion mounted in the weapon handle and a forward and downward angular offset portion extending to an aiming light end of the mounting bracket upon which an infrared aiming light is mounted. The forward and downward angular offset portion conveniently places a dead man switch that is on the front of the infrared aiming light close to the weapon operator's hand so that the operator may simultaneously operate the aiming light while bracing the weapon handle. After zeroing in the beam of the aiming light with the bore of the weapon, the bracket and/or infrared aiming light may be disassembled and reassembled without loss of zero.

4 Claims, 6 Drawing Figures

INFRARED AIMING LIGHT MOUNTING BRACKET FOR WEAPON

The invention described herein may be manufactured, used, and licensed by the U.S. Government for governmental purposes without the payment of any royalties thereon.

BACKGROUND OF THE INVENTION

1. Field of the Invention.

The present invention is in the field of mounting brackets that provide a novel means of mounting and dismounting an infrared (IR) aiming light to a small caliber weapon, such as the U.S. Army M16 rifle.

2. Description of the Prior Art.

Previously, IR aiming lights were mounted on top of the weapon. A switch on the IR aiming light had to be activated when the soldier desired to illuminate an enemy nighttime target along the boresight of the weapon with a narrow IR light beam emitted from the IR aiming light. Since the beam is easily detected, the amount of time that the beam is activated needs to be minimized. With the IR aiming light, and thus the switch, on top of the weapon, the rifleman had to release his hold on the handle of the weapon when reaching on top of the weapon to activate the switch of the IR aiming light. The present mounting bracket makes it possible for the operator to continuously brace the weapon and selectively activate the IR aiming light simultaneously to minimize IR beam detection time and yet provide more accurate sighting for firing at the enemy target.

SUMMARY OF THE INVENTION

The present IR aiming light mounting bracket is comprised of a novel angular offset portion that extends forward and downward from a weapon end of the mounting bracket for mounting an IR aiming light thereon at an aiming light end. The mounting bracket further has a bracket shoe at the weapon end that fits onto the foot of a weapon handle and a tapered thumb screw locking pin that fits snugly into a hole in the upper half of the weapon handle. The bracket shoe has front and rear pads therein that fit firmly against the foot of the weapon handle to form two points of mounting. The thumb screw locking pin, threadably connected to a thumb wheel, provides the third mounting point of a three point-mounting arrangement to provide a more stable mounting bracket than was possible in prior art brackets. The locking pin is positioned about half way between the front and rear pads and, when fully extended by the thumb wheel, fits snugly into a locking pin hole in the weapon handle and pushes the front and rear pads, within the shoe of the mounting bracket, firmly against the foot of the weapon handle. A retaining means, such as a detent spring or ball plunger, may be tightened down against the outside knurled portion of the thumb wheel to prevent the thumb wheel from vibrating loose, and thus loosening the IR aiming light mounting bracket from the weapon.

A front portion of the mounting bracket has an aiming light shoe upon which the foot portion of an IR aiming light is mounted by some screw threadable means wherein a dead man switch on the IR aiming light is conveniently positioned in the proximity of the weapon operator's hand which braces the weapon so that the operator continuously braces the weapon while selectively activating the dead man switch with the thumb of the bracing hand. The foot of the aiming light and the foot of the weapon are both compatibly fit to their respective mounting bracket shoes.

The specifics of the present IR aiming light bracket will be better understood in view of the detailed description herein below in reference to the following drawings.

DETAILED DESCRIPTION OF THE PREFERRED EMBODIMENTS

Figure 1:
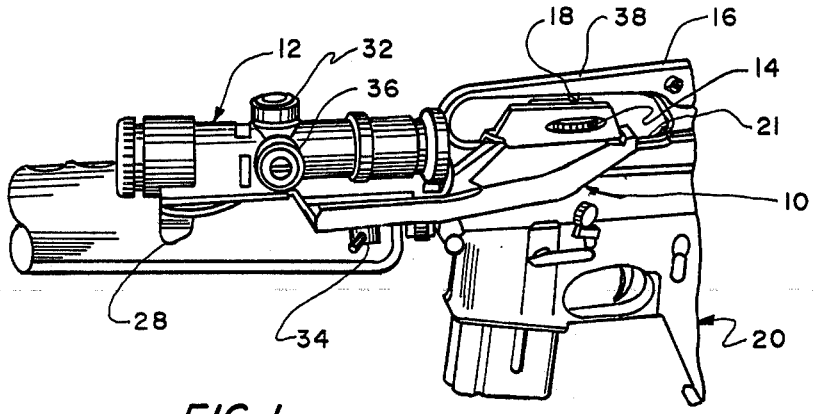
FIG. 1 illustrates the IR aiming light mounting bracket attached to a weapon with an IR aiming light mounted thereon.

Refer to FIGS. 1 through 6 for the following explanation. FIG. 1 shows the IR aiming light mounting bracket 10 mounted to the weapon handle 16 of a partially shown weapon 20, i.e. the breech part thereof. Numeral 25 in FIGS. 5 and 6 indicates the bracket shoe portion of the mounting bracket 10. The bracket shoe portion is comprised of front pad 22 and rear pad 24 having therebetween two beveled side relief areas 23 and a central flat relief area 23A. Front and rear pads 22 and 24 preferably have raised portions both on the two beveled sides, but may also be raised in the central flat area between the beveled sides. Front and rear pads 22 and 24 fit snugly against the weapon foot 21, but the relief areas 23 and 23A are recessed so that their face areas never touch the weapon foot 21.

A beveled thumb screw locking pin 18 is threadably connected to a mounting bracket thumb screw 14 such that thumb screw 14 threads the beveled end of pin 18 into a locking pin hole 38 in the weapon handle 16 (which cannot clearly be shown in FIG. 1 but is enumerated thereon). The pressure points at the beveled end of pin 18 in the locking pin hole 38 and pads 22 and 24 form the three points in the three point-mounting arrangement. A cut-out portion in the base of pin 18 forms a flat face area 18A. Flat face area 18A is kept from turning by a spring pin 26 which may be pressed or threaded through the mounting bracket against the area 18A. Once pin 18 is firmly threaded between hole 38 and foot 21, a retaining means 30, such as a detent spring or ball plunger, is threaded against the knurled outer edge of thumb wheel 14 to keep the thumb wheel from vibrating loose.

Figure 2:
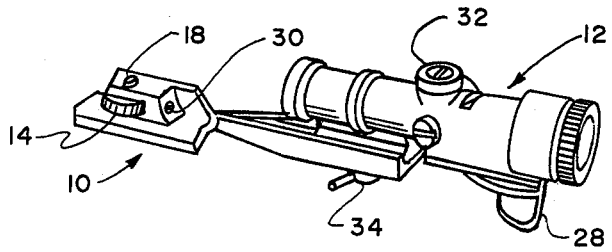
FIG. 2 shows only the mounting bracket and the IR aiming light mounted thereon.

FIG. 2 shows the IR aiming light 12 mounted to the aiming light end 13 (as more clearly indicated in FIGS. 3, 4, 5, and 6 of the amounting bracket 10 by a screw threadable means, such as a captivating lever screw assembly 34. The dead man switch 28 may easily be selectively activated by the weapon operator while the operator's hand is on the weapon handle of weapon 20. FIG. 1 illustrates an arrangement of the IR aiming light and mounting bracket wherein the operator is right handed, i.e. the operator may brace the weapon handle and activate the dead man switch 28 with his other hand, or the left hand. It should be noted that the present mounting bracket and IR aiming light dead man switch may be activated by a left handed operator as well. The IR aiming light 12 has elevation adjustment means 32 and azimuth adjustment means 36 which are used to zero the IR aiming light beam with the bore of the weapon.

Figure 6:
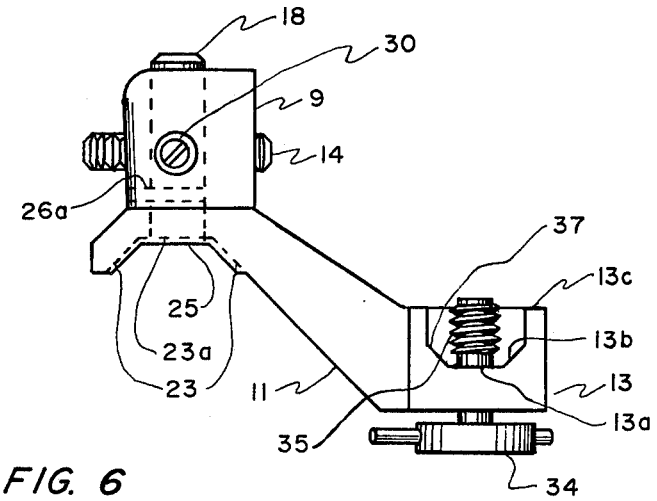
FIG. 6 illustrates a front view of the mounting bracket.
Figure 4:
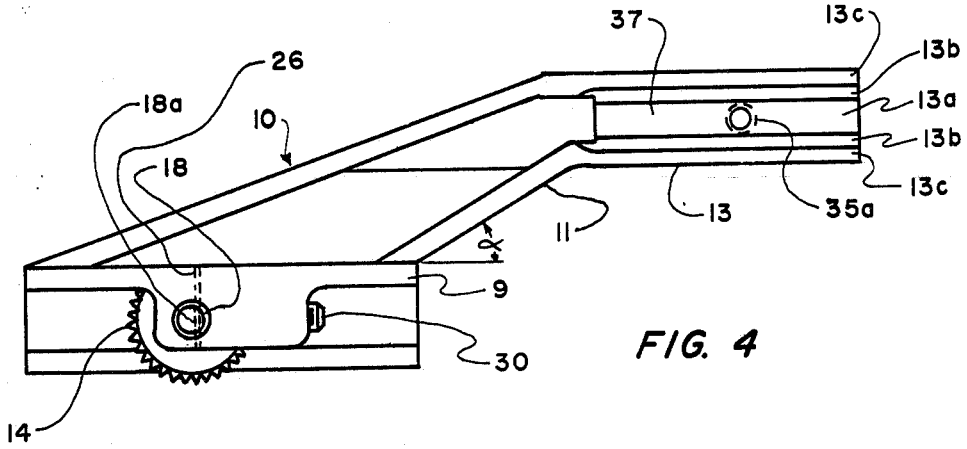
FIGS. 4 and 5 show respectively top and bottom views of the mounting brackets.
Figure 3:
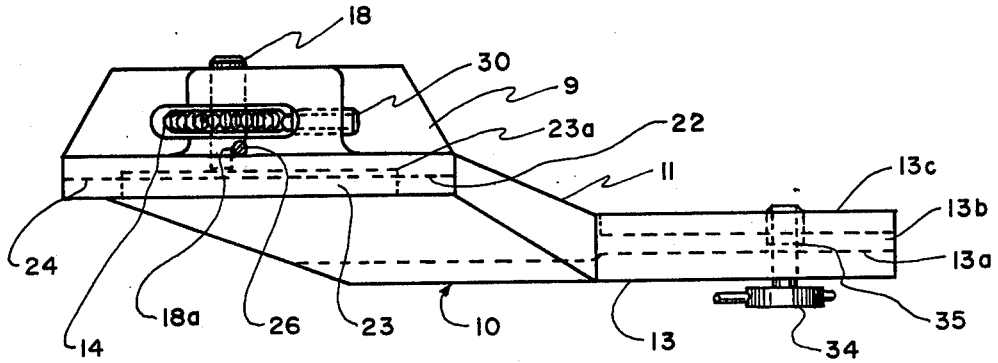
FIG. 3 illustrates a side view of the mounting bracket looking away from the weapon.
Figure 5:
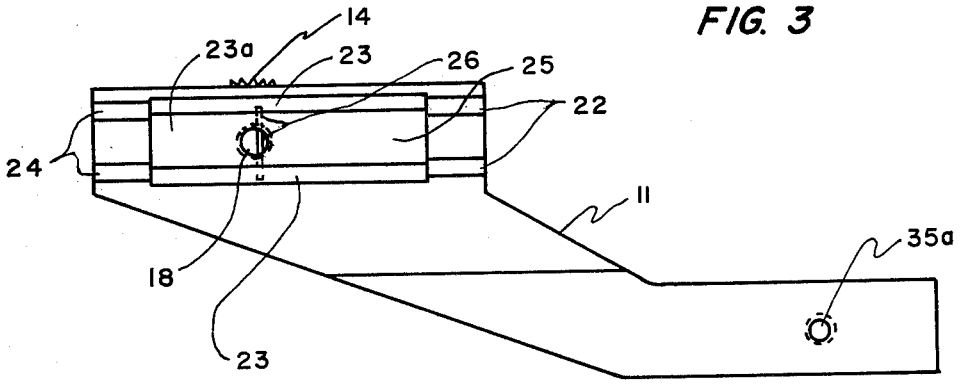

The preferred construction of the present mounting bracket 10 is shown in FIGS. 3, 4, 5, and 6. Numeral 9 represents the weapon end of the mounting bracket, and numeral 13 represents the aiming light end of the mounting bracket. Numeral 11 represents the angular offset forward and downward portion of the mounting bracket that is offset by angle $\alpha$, wherein the value of $\alpha$ may typically be 30°. FIG. 3 specifically depicts a side view of the mounting bracket looking out from the weapon. FIG. 4 is a top view which shows aiming light shoe 37 of the mounting bracket. FIG. 6 shows a front view of bracket 10. Shoe 37 is comprised of outer ridges 13C, beveled side portions **13*b* and a flat base portion 13A. If the beveled side portions 13B continued and met each other, the resulting angle formed should be about 90°. The captivating lever screw assembly 34 has a lever screw 35 that is screw threaded through the lever screw hole 35A of aiming light end 13 to attach the IR aiming light thereto. Numeral 26A of FIG. 6 represents the spring pin 26** hole, which may be smooth for a press fit or threaded for a threadable pin.

Thus, one improvement in the present infrared aiming light mounting bracket for an IR aiming light over prior mounting brackets is that the IR aiming light is specifically made to have an offset portion so that the aiming light is positioned near the weapon operator's hand that braces the stock of the weapon where he can activate the IR aiming light dead man switch while continuously bracing the weapon. Another improvement in the mounting bracket is the three point-mounting arrangement within the weapon handle to make the bracket more sturdy than previous mounting brackets. Further, the mounting bracket and the IR aiming light may be conveniently mounted and dismounted on the weapon as appropriate for either nighttime or daytime operation without loosing the zero of the IR aiming light with the bore of the weapon, or without disturbing the regular daytime sights on the weapon.

The overall length of the mounting bracket is preferably about 7.18 inches, with a total width of about 2.47 inches measured across the aiming light end, the offset portion, and the weapon mounting end. The overall height with the above length and width measurements is preferably 1.835 inches measured from the bottom of the aiming light end to the top of the weapon end.

I claim:

1. An infrared aiming light mounting bracket for conveniently mounting and dismounting an infrared aiming light to a weapon wherein the weapon operator may selectively activate said infrared aiming light while continuously bracing the weapon handle, said infrared aiming light mounting bracket comprising:

a weapon end of said mounting bracket having a three point-mounting arrangement therein in which said weapon end is comprised of a bracket shoe having a front pad and a rear pad and relief areas between said front and rear pads wherein said bracket shoe is compatible with the foot of a weapon handle and a tapered thumb screw locking pin and a thumb wheel that is threadably connected to said tapered thumb screw locking pin to extend and lock said tapered thumb screw locking pin firmly into a hole in the upper half of the weapon handle wherein the tapered portion of said tapered thumb screw locking pin forms one point of said three point-mounting arrangement and wedges said mounting bracket firmly against the weapon handle at said front and rear pads wherein said front and rear pads form the other two points of said three point-mounting arrangement;

an aiming light end of said mounting bracket comprised of an aiming light shoe compatible with an IR aiming light foot, and a screw threadable means that is screw threadably connected into said IR aiming light foot to firmly set said IR aiming light into said aiming light end of the mounting bracket; and an angular offset portion of said mounting bracket that extends forward and downward from said weapon end to said aiming light end of the mounting bracket wherein said IR aiming light has a dead man switch placed in the proximity of the weapon handle bracing hand of the weapon operator so that the thumb of the bracing hand of said weapon operator may selectively activate said IR aiming light by use of said thumb against said dead man switch while continuously bracing said weapon at said weapon handle.

2. A mounting bracket as set forth in claim 1 wherein both of said front pad and rear pad in the weapon handle shoe are comprised of raised portions on beveled sides and on a central flat area between said raised portion beveled sides with said relief areas formed on the remainder of said beveled sides and central flat area between the raised portion beveled sides and raised portion central flat area.

3. A mounting bracket as set forth in claim 2 wherein said aiming light shoe has outer ridges with smooth sides extending down to beveled side portions of about 45° which extend to a flat base portion upon which said foot of the IR aiming light fits.

4. A mounting bracket as set forth in claim 3 wherein said screw threadable means is comprised of a captivating lever screw assembly.

* * * * *